US006286444B1

(12) United States Patent
Swaney

(10) Patent No.: US 6,286,444 B1
(45) Date of Patent: Sep. 11, 2001

(54) AUTOMATIC BOBBIN CHANGER AND METHOD

(75) Inventor: Raymond D. Swaney, Plantation, FL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/524,864

(22) Filed: Mar. 14, 2000

(51) Int. Cl.[7] ..... D05B 11/00; D05B 59/04
(52) U.S. Cl. ..... 112/117; 112/278; 112/279
(58) Field of Search ..... 112/117, 279, 112/188, 186, 278

(56) References Cited

U.S. PATENT DOCUMENTS

| | | | | |
|---|---|---|---|---|
| 3,376,838 | * | 4/1968 | Schiffmacher et al. | 112/279 X |
| 5,400,730 | * | 3/1995 | Moll et al. | 112/279 |
| 5,584,257 | * | 12/1996 | Nakamura et al. | 112/279 |
| 5,603,273 | * | 2/1997 | Nakamura et al. | 112/279 X |
| 5,718,181 | * | 2/1998 | Shinozuka et al. | 112/279 |

FOREIGN PATENT DOCUMENTS 0 953 665 A2 11/1999 (EP) .

* cited by examiner

*Primary Examiner*—Ismael Izaguirre
(74) *Attorney, Agent, or Firm*—Wood, Herron & Evans L.L.P.

(57) ABSTRACT

An apparatus for automatically changing a bobbin case on a quilting machine having a hook drive operatively supporting the bobbin case during a stitching operation. The apparatus includes a staging station adapted to support at least one bobbin case normally having a full spool of thread, and a carriage movable between the staging station and the hook drive. A finger is movably mounted on the carriage, and the finger moves a release lever on the bobbin to an unlock position and clamps the release lever at the unlock position. A method of using the above apparatus in an automatic bobbin changing operation is also provided. A controller determines the need for a bobbin change, for example, by counting stitches and calculating the thread remaining on the bobbin. The bobbin change can be carried out between patterns or during a pattern by cutting the bobbin thread or both the top and bottom threads. The sewing of tacking stitches may also be done in sequence with the thread cutting and bobbin changes.

29 Claims, 4 Drawing Sheets

AUTOMATIC BOBBIN CHANGER AND METHOD

FIELD OF THE INVENTION

The present invention relates to quilting machines, and particularly to an apparatus and methods for automatically changing a bobbin on a quilting machine.

BACKGROUND OF THE INVENTION

In quilting machines of various types, threads are applied and manipulated on opposite sides of a fabric to form one or more patterns of stitches. The proper formation of the stitches of each series requires the movement and precise timing of cooperating stitching elements. Some quilts are stitched with continuous patterns along webs of material that is later cut, without the need to start and stop the quilting of a pattern in the midst of a quilted product. Many standard mattress covers are quilted on multi-needle quilting machines in this manner. Other patterns start and stop on a quilted product, which might include a number of discrete disconnected pattern components on a given quilted product. Multi-needle quilting machines can quilt mattress covers in this manner, as described in commonly assigned U.S. Pat. Nos. 5,154,130 and 5,544,599, hereby expressly incorporated herein by reference. Comforters and certain more expensive mattress covers are quilted as single panels on single needle quilting machines in this manner, as described in commonly assigned U.S. Pat. Nos. 5,650,916, 5,685,250 and 5,832,849, hereby expressly incorporated by reference herein. When a pattern starts or stops on a product, at the end of the stitching of a pattern, a tack is usually sewn, thread is cut, and the relative position of the fabric and the stitching elements is changed to sew another stitched pattern on the same or on another product.

Multi-needle quilting machines and some single needle quilting machines for quilting mattress covers and other quilted products having only one outer finished side use a double lock chain stitch. The chain stitch is formed by poking loops of a bottom thread through loops of a top thread, and can be employed using large spools of top and bottom threads, but because the loops are visible on the underside of the product, one side of the product is unattractive. Single needle machines and some multi-needle machines for quilting comforters and mattress covers and other products use a lock stitch. The lock stitch is formed by passing the bottom thread once through each loop of the top thread, which, by taking up the top thread loop so that the thread crossings are essentially within the quilted material, produces a line of stitches that appear the same from both sides. Forming of a lock stitch requires passing the entire bottom thread supply through each top thread loop. As a result, lock stitch machine use small quantities of thread would on a bobbin so that the top thread loop can be hooked and rotated around the bobbin and hence the single strand of bottom thread.

Many lock stitch quilting machines have a common structure in which a reciprocating needle is mechanically coupled to an upper sewing head motor located above a layered fabric. The needle reciprocates through layered fabric and through a needle plate supporting the layered fabric. With a lockstitch quilting machine, a lower sewing head includes a hook drive that is mechanically coupled to a bobbin case containing a spool of thread. The lower sewing head may be linked to and driven by the needle drive motor or by the hook drive motor, synchronized to the needle motion, to move the hook drive around the bobbin case to pick up thread from the spool in synchronization with the motion of the needle and thread below the layered fabric. The thread from the reciprocating needle and the thread from the bobbin case form a lockstitch securing the layers of fabric together in a known manner.

The nature of the lockstitch requires that the bobbin thread be reduced to a minimum size in order to allow the thread from the needle to be rotated about the bobbin case thread to form the stitch. The limited size of the bobbin case limits the quantity of thread that can be stored within the bobbin case. Usually, in commercial lockstitch quilting, some scheme is used to alert a machine operator when there is insufficient thread left on the bobbin to quilt a complete quilted product, so that the operator can change bobbins manually before starting a product. Otherwise, it is necessary for the operator to manually operate the machine to cut thread, tack the stitches if necessary, and change bobbins in the middle of a quilted patter.

When quilting larger workpieces, for example mattress covers, a particular stitch pattern may require more thread than can be stored in a common, commercially available bobbin case. Therefore, the thread spool and bobbin case would have to be changed in the middle of a workpiece quilting cycle. An manual operation to change a bobbin, particularly in the middle of the quilting of a pattern, requires that a machine operator stop the operation of the upper and lower sewing head motors, manually command the quilting machine to move the sewing heads to a maintenance position and remove the bobbin case with the empty thread spool. Thereafter, the machine operator must install a bobbin case with a full thread spool, command the quilting machine to move the sewing heads back to the position where the bobbin thread ran out and reinitiate the stitching cycle. Such a bobbin case changing operation is labor intensive, time consuming, inefficient, extends the time required for part production and thus, adds significant cost to the production of the workpiece.

Therefore, there is a need to provide apparatus and methods for automatically changing a bobbin case on a quilting machine, thereby substantially improving its efficiency.

SUMMARY OF INVENTION

The present invention provides methods and apparatus for operating a quilting machine that are more efficient than known methods and apparatus. The methods and apparatus of the present invention improve the state of automation of a lock stitch quilting machine by reducing the labor required, reducing the time required to stitch patterns and thus, substantially reducing the production of patterns stitched with the quilting machine. The invention is especially useful when stitching large patterns of layered fabric which exceed the amount of thread stored in the bobbin case and require the bobbin case be changed in the middle of stitching the pattern.

In accordance with the principles of the present invention and the described embodiments, the invention provides an apparatus that automatically changes a bobbin case on a quilting machine having a hook drive operatively supporting the bobbin case during a stitching operation. The apparatus includes a bobbin staging station adapted to support at least one bobbin case normally having a full spool of thread, and a carriage movable between the bobbin staging station and the hook drive. A finger is movably mounted on the carriage, and the finger moves a release lever on the bobbin case to an unlock position and clamps the release lever at the unlock position.

In one aspect of the invention, the finger engages a rear side of the release lever and pivots the release lever to the unlock position. In another aspect of the invention, the lever clamps the release lever against a stop, for example, a stop made from a resilient material. In a further aspect of the invention, the finger is operated by a reciprocating cylinder. In a still further aspect of the invention, the carriage is movable in mutually perpendicular directions in moving between the bobbin staging station and the hook drive.

In another embodiment, the present invention includes a method of automatically changing a bobbin case on a quilting machine having a hook drive operatively supporting the bobbin case during a stitching operation. The method first moves a carriage to a position adjacent a first bobbin case mounted on the hook drive. Next the release lever of the first bobbin case is mechanically pivoted to an unlock position, thereby unlocking the first bobbin case from the hook drive. The release lever of the first bobbin case is then mechanically clamped in the unlock position; and the carriage is moved away from the hook drive, thereby removing the first bobbin case from the hook drive. The release lever of the first bobbin case is then unclamped, thereby permitting the first bobbin case to drop from the carriage; and the carriage is moved to a position adjacent a second bobbin case. The release lever of the second bobbin case is mechanically pivoted to the unlock position, and the release lever of the second bobbin case is mechanically clamped at the unlock position. The carriage is then moved to the location adjacent the hook drive; and the release lever of the second bobbin case is unclamped, thereby mounting the bobbin case onto the hook drive.

Thus the method and apparatus of the present invention automatically changes a bobbin case on a quilting machine with the advantages of eliminating the labor, time and cost of changing bobbin cases manually in the middle of stitching a large pattern on a lock stitch quilting machine.

The invention also provides automatic operation of the bobbin change mechanism between the stitching of different patterns, or during the stitching of a pattern by determining the need therefore through, for example, the counting of stitches. The bobbin changes may be performed in sequence with the cutting of the bobbin thread only or the cutting of both top and bottom threads, and/or in sequence with the sewing of tacking stitches before and/or after the thread cut and bobbin change.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF THE INVENTION

Figure 1:
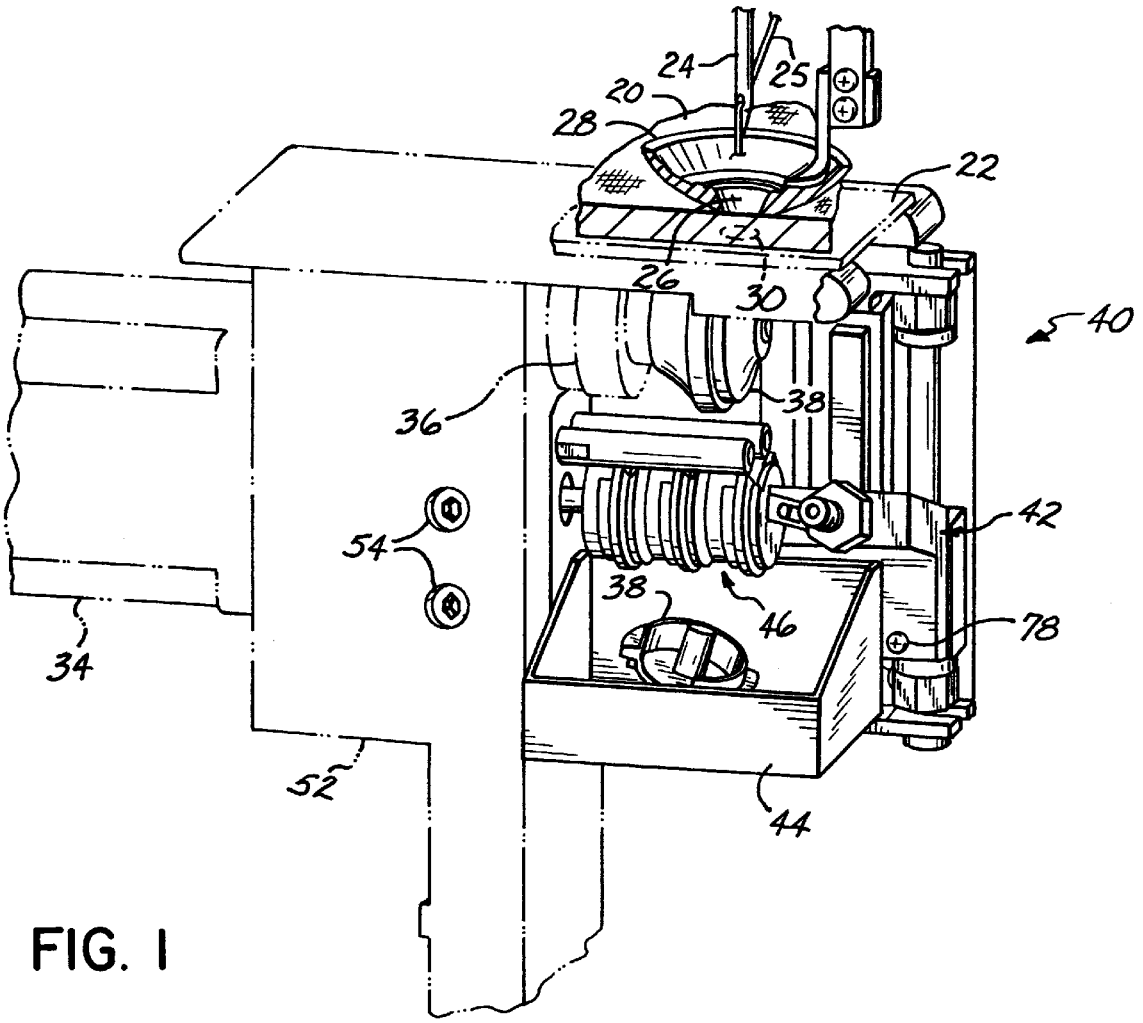
FIG. 1 is a perspective view of an automatic bobbin changer mounted in relation to known components of a quilting machine in accordance with the principles of the present invention.

The components of FIG. 1 that are shown in phantom are known quilting machine components that form a lockstitch in a known manner. The layers of fabric 20 to be stitched are laid out on top of a needle plate 22 of a quilting machine. A needle 24 is mounted in an upper sewing head motor and drive (not shown) which is located above a presser foot 28 in a known manner. The needle 24 and thread 25 reciprocate vertically through a hole 26 in the presser foot 28, through the layers of fabric 20 and then through a hole 30 of the needle plate 22. When sewing a lockstitch, a lower sewing head motor 34 is mechanically coupled to a hook drive 36 supporting a bobbin case 38 containing a spool of thread (not shown). The lower sewing head motor 34, in a known manner, moves the hook drive 36 around the bobbin case 38 to pick up thread (not shown) from the spool in synchronization with the motion of the needle 24 and the thread 25 below the layered fabric. The thread 25 from the reciprocating needle 24 and the thread from the bobbin case 38 are thus formed into a lockstitch securing the layers of fabric 20 together.

The motion of the thread 25 with respect to the lower thread from the bobbin case 38 requires that the bobbin case be of a relatively small size. The small size limits the quantity of thread that can be stored in the bobbin case. Consequently, a bobbin case may run out of thread in the middle of sewing the layered fabric 20, require changing. When a quilting machine control, such as a programmed controller 140 (FIG. 3), determines that the spool within the bobbin case 38 is empty, a bobbin changer 40 is commanded by the control to execute a bobbin change cycle. In the bobbin change cycle, a carriage 42 is moved from a rest position, as illustrated, upward to a position opposite the hook drive 36, and the bobbin case 38 is removed from the hook drive 36 to the carriage 42. The carriage 42 then moves to a position over a used bobbin tray 44, and the bobbin case 38 with the used thread spool is dropped into the tray 44. The carriage 42 then moves into alignment with a bobbin staging station 46, which is the position illustrated in FIG. 1. The staging station 46 contains a plurality of bobbin cases 38 each containing a full spool of thread. At the staging station, the carriage 42 picks up one of the full bobbin cases 38, moves it to a position opposite the hook drive 36 and loads the full bobbin case 38 onto the hook drive. The quilting machine is then ready to resume its sewing operation.

Figure 2:
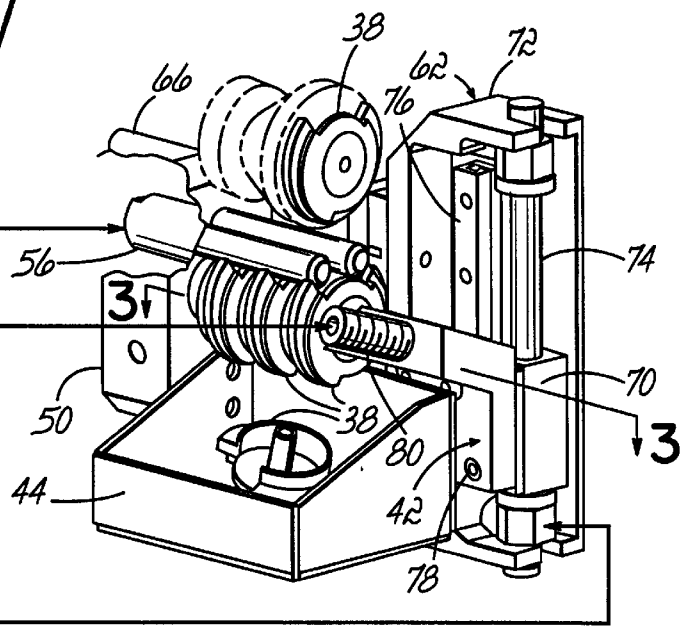
FIG. 2 is a perspective view partially broken away of the automatic bobbin changer of FIG. 1, however, the hook drive is not shown in FIG. 2.
Figure 2:
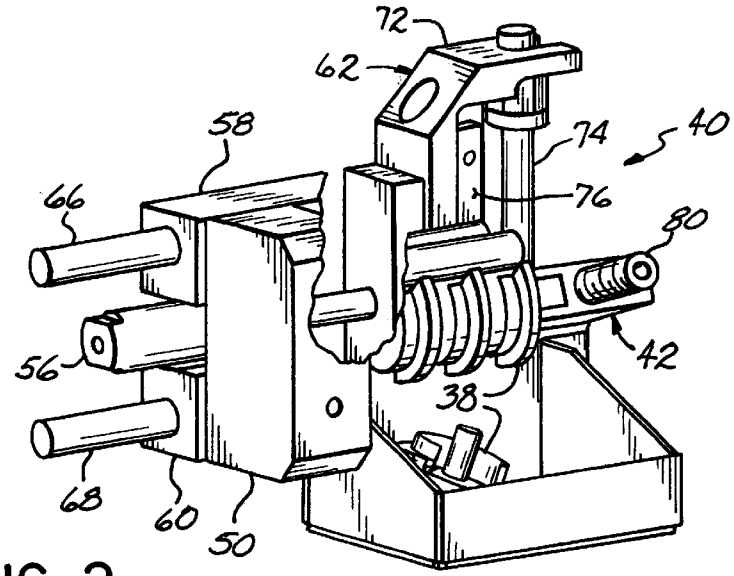
Figure 3:
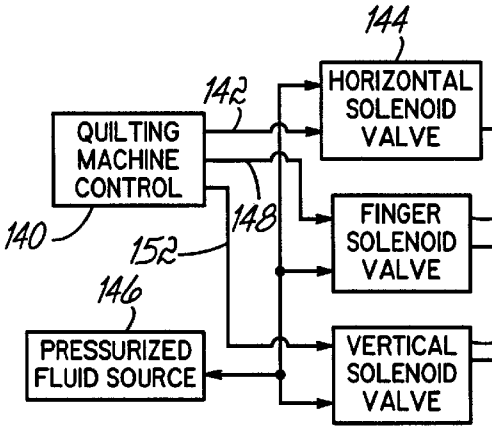
FIG. 3 is another perspective view of the automatic bobbin changer of FIG. 1 and includes a schematic block diagram of control elements operating the bobbin changer.

Referring to FIGS. 2 and 3, the automatic bobbin changer 40 has a mounting block 50 that functions to mount the automatic bobbin changer 40 to a lower sewing head base mount 52 (FIG. 1) by means of fasteners 54. The mounting block 50 is rigidly connected to a first drive 56, for example, a horizontal cylinder and upper and lower horizontal guides, 58, 60, respectively. The horizontal cylinder 56 is a fluid operated cylinder, for example, a cylinder operated with pressurized air and commercially available as part no. TE-021 from Bimba Manufacturing of Monee, Illinois. A horizontal slide 62 is rigidly connected to a distal end of a horizontal cylinder rod 64 extending from the horizontal cylinder 56. The horizontal slide 62 is also connected to the distal ends of upper and lower rails 66, 68 that slidingly mount within the respective guides 58, 60. Thus, the cylinder 56 operates to translate the horizontal slide 62 back and forth along a first axis of motion, for example, in the horizontal direction.

A second drive, which includes a vertical cylinder 74, is rigidly mounted at its ends within a C-shaped frame 72 on the horizontal slide 62. The vertical cylinder 74 is a fluid operated cylinder, for example, a cylinder operated with pressurized air and commercially available as part no. NCY2B6H-1.75 from SMC Pneumatics of Indianapolis, Indiana. A cylinder slide 70 is magnetically coupled to a piston within the cylinder 74. A vertical guide rail 76 is mounted to an interior portion of the C-shaped frame 72 and, referring to FIG. 4, has a bearing slide 77 slidably mounted thereon. The bearing slide 77 and cylinder slide 70 are rigidly attached to a connecting link or plate 79, for example, by welding, with fasteners or other appropriate means. The connecting plate 79 is attached to the carriage 42 by fasteners 78 (FIG. 3). The assembly of the cylinder 74, guide rail 76 and connecting plate 79 function to translate the carriage 42 along a second axis of motion, for example, up and down in a vertical direction. Thus, the horizontal cylinder 56 and the vertical cylinder 74 are used to move the carriage 42 along mutually perpendicular axes of motion between the hook drive 36 and the bobbin staging station 46 (FIG. 1).

Figure 5:
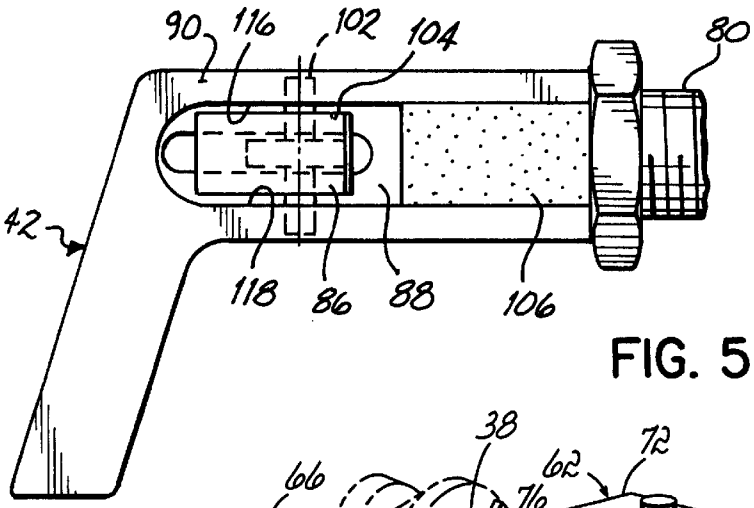
FIG. 5 is a side view of the carriage of the automatic bobbin changer of FIG. 1.
Figure 4:
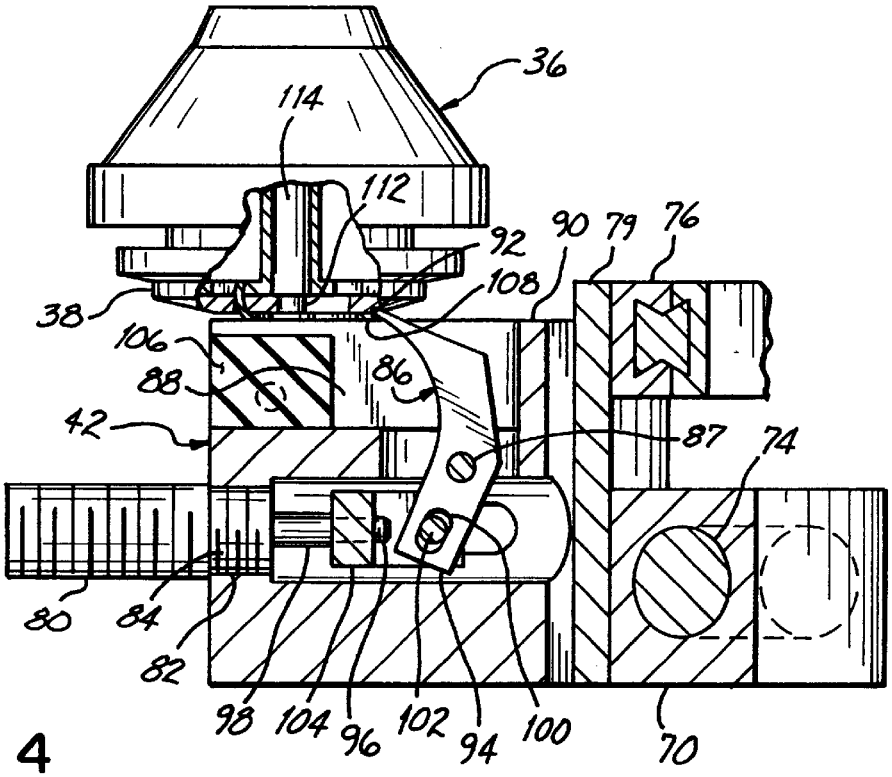
FIG. 4 is a partial cross-sectional view taken along line 4—4 of FIG. 3 and illustrating a first operation of the automatic bobbin changer of FIG. 1.
Figure 6:
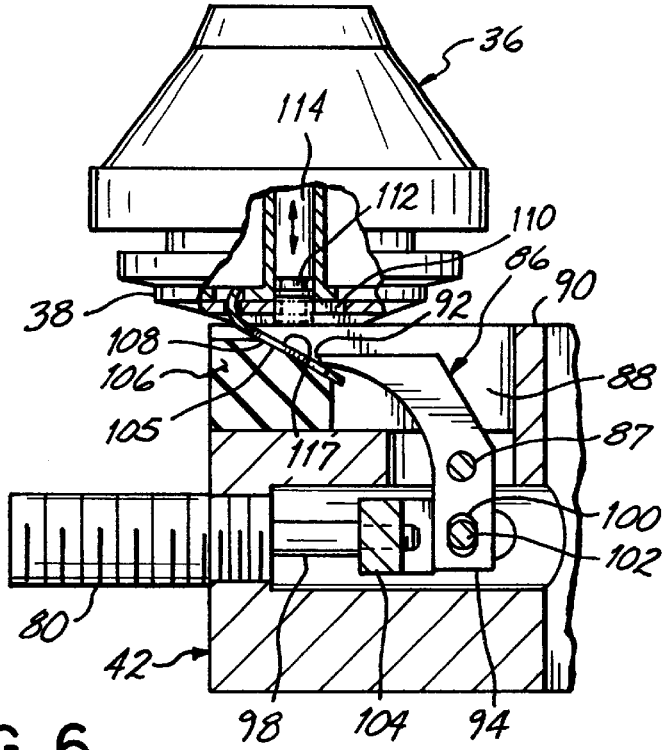
FIG. 6 is a partial cross-sectional view taken along line 4—4 of FIG. 3 and illustrating a second operation of the automatic bobbin changer of FIG. 1.

Once the carriage is aligned with either the hook drive 36 or the bobbin staging station 46, the bobbin case 38 containing the thread spool is transferred to or from the carriage 42. Referring to FIGS. 4–6, a finger cylinder 80 is mounted in a bore 82 of the carriage 42, for example, by threads 84 or other appropriate structure. The fluid cylinder 80 is a fluid operated cylinder, for example, a pressurized air operated cylinder with an internal return spring and commercially available as part no. AL2RRO-1/4 from Watson Pneumatics of Cleveland, Ohio. A finger 86 is mounted on a pivot pin 87 within a slot 88 in the forward side 90 of the carriage 42. When the finger 86 is at its first disengaged position as illustrated in FIG. 4, the outer end or tip 92 of the finger 86 extends slightly beyond the plane of the forward side 90 of the carriage 42. The inner end 94 of the finger 86 is pivotally mounted to a distal end 96 of the rod 98 extending from the finger cylinder 80. While the finger 86 may be mounted to the finger cylinder rod 98 with several different constructions, in this embodiment, the inner end 94 of the finger 86 has an elongated slot 100. A pin 102 extends through the slot 100 and is fixed at its ends to opposite sides of a U-shaped clevis 104 mounted on the distal end 96 of the finger cylinder rod 98. A stop 106 in the form of a deformable, resilient pad, for example, a rubber pad, is rigidly fixed within the slot 88 of the carriage 42.

The bobbin case 38 is operatively connected to the hook drive 36 in a known manner. A release lever 108 is pivotally mounted to the front of the bobbin case 38, and an outward, clockwise pivoting motion of the lever 108 causes a locking tab 110 to translate to the left as viewed in FIG. 4. The leftward translation moves the locking tab 110 out of a slot 112 of a center shaft 114 of the hook drive 36. Thus, pivoting the release lever 108 from a first, lock position outward to a second, unlock position, thereby unlocking the bobbin case from the hook drive 36 and permitting the bobbin case 38 to be removed therefrom.

Referring to FIGS. 2 and 3, when the carriage 42 has been moved to its upper, inward position, the carriage 42 is immediately adjacent the hook drive 36. As illustrated in FIG. 4, the outer end 92 of the finger 86 is positioned immediately adjacent the movable end of the bobbin case release lever 108 located at its lock position. Referring to FIG. 6, actuating the finger cylinder 80 causes the finger cylinder rod 98 to extend, thereby pivoting the finger 86 in a generally counterclockwise direction as viewed in FIG. 6. As the finger 86 begins to pivot, its outer end 92 engages a rear side 117 of the pivoting lever 108 of the bobbin case 38. The pivoting finger 86 applies a force against the rear side of the lever 108, thereby pivoting the release lever 108 outward to the unlock position. The finger 86 holds the release lever 108 in the unlock position by clamping the lever 108 against a stop surface 105 on the stop 106. Further, the bobbin case 38 is pulled against the forward side 90 of the carriage 42, thereby securing the bobbin case 38 to the carriage 42. The release lever 108 is also supported between the upper and lower walls 116, 118, respectively, of the slot 88 shown in FIG. 5. Thus, the bobbin case 38 is now being carried by the carriage 42; and by actuating the horizontal cylinder 56, the bobbin case 38 is removed from the hook drive 36 and carried to another location, for example, to the used bobbin tray 44 (FIG. 1).

To release the bobbin case 38 from the carriage 42, the finger cylinder 80 is actuated so that the finger cylinder rod 98 retracts back into the cylinder 80, and the finger 86 rotates clockwise as viewed in FIG. 6, to the position illustrated in FIG. 4. That motion of the finger 86 releases the lever 108 from the stop 106 which allows the lever 108 to return to its lock position as illustrated in FIG. 4; and the bobbin case 38 is released from, and no longer supported by, the carriage 42.

Figure 7:
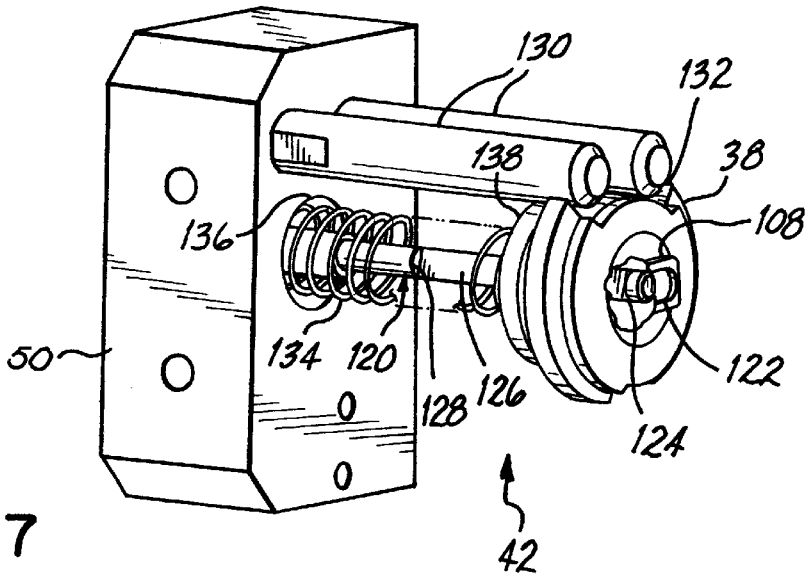
FIG. 7 is a perspective view of only the bobbin staging station of the automatic bobbin changer of FIG. 1.

Referring to FIG. 7, the bobbin staging station 46 has a staging rod 120 with one end rigidly connected to the mounting block 50. The rod 120 has a distal end 122 with a circular, cross-sectional profile. Immediately behind the distal end 122, the shaft 120 is relieved or cutaway, beginning at 124, to form a noncircular, cross-sectional profile. The cutout 126 formed by the noncircular, cross-sectional profile has a flat surface that extends longitudinally along the rod to a location, at 128, where the circular, cross-sectional profile begins again. A pair of guide rods 130 are rigidly secured at one end to the mounting block 50. The guide rods 130 are spaced to extend through a cutaway portion 132 in the outer periphery of the bobbin case 38, thereby maintaining the bobbin case 38 in the desired angular orientation on the staging shaft 120.

As previously discussed with respect to FIGS. 4–6, with the release lever 108 of the bobbin case 38 pivoted outward to its unlock position, the bobbin case 38 can readily slide over the circular, distal end 122 of the staging shaft 120. After the bobbin case is mounted on the staging shaft 120, the lever 108 is released; and as the release lever 108 returns to its lock position, it moves a locking tab into the cutout 126 of the staging shaft 120, thereby prohibiting the bobbin case 38 from being moved outward past the circular, distal end 122. A biasing element, for example, a compression spring 134, has one end mounted in a bore 136 of the mounting block 50 and an opposite end contacts a rear side 138 of the bobbin case 38. Thus, the spring 134 applies a biasing force to maintain the bobbin case 38 as close as possible to the circular, distal end 122 of the staging shaft 120.

In use, the quilting machine control 140 (FIG. 3) keeps track of the thread being used from the spool of thread in the bobbin case 38. The controller 140 typically will be a programmed controller of the quilting machine that contains data of the shapes of the patterns to be quilted, and can contain other parameters for scheduling and operating the machine for different products to be quilted. The quilting machine control 140 is programmed with the length of stitch and keeps track of the relative position of the presser foot 28 with respect to the needle plate 22 representing the thickness of the layer of material 20 being sewn. Therefore, the control 140 is able to determine the amount of thread being used from the bobbin spool with each stitch. The number of stitches can be determined in one of several ways depending on the data available on the quilting machine. For example, each reciprocation of the needle 24 or rotation of the upper sewing motor can be detected and counted by the control 140. Alternatively, each cycle of the hook drive 36 can be detected directly from the motion of the hook drive or by the operation of the lower sewing head motor 34. Finally, the number of stitches in a pattern and the amount of thread on a full spool is known and programmed into the quilting machine control 140. Given the above data or by other methods known in the art, the quilting machine control 140 is able to determine a bobbin stitch count, that is, the number of stitches that can be sewn starting with a full spool of thread on the bobbin before the spool of thread reaches a state at which it should be changed.

When the control 140 determines that a bobbin change is needed, the change may be implemented in one of a number of sequences. A bobbin change may be implemented by determining that the amount of thread left on a bobbin is less than that needed to complete the next scheduled product. When such a determination is made, a bobbin change can be caused to be executed between products, for example, after the pattern of one product has been completed, tack stitches are sewn, and the thread has been cut, but before the pattern is started on the next product. Such a bobbin change can be executed also when a determination that bobbin thread must be changed for another reason, such as a scheduled change in color or thread type for the next product.

A bobbin change may also be caused to be executed by the quilting machine controller 140, during the quilting of a pattern upon the determination that the thread on the bobbin is running out. When this determination occurs, the control 140 may cause the pattern stitching to stop, the bottom thread from the bobbin to be cut, and the bobbin to be changed, whereupon the pattern stitching is resumed. The thread cutting may involve the cutting of both top and bottom threads just as they would be cut at the end of a pattern, or with only the bottom thread cut.

When all threads are cut, a standard procedure is to stop the machine with the top thread extending from the needle eye through the needle plate hole below the fabric, around the hook and back through the needle plate hole to the last stitch formed in the material. A cutter below the needle plate then typically moves against the threads, displaces the top thread extending from the needle and then cuts both the top thread that extends through the hole in the needle plate from the material and the bottom thread that extends through the hole from the material to the bobbin. Usually it will be desirable to sew a tack in the pattern before cutting the thread. Also, it may be desirable to sew another tack immediately after resuming the stitching of the pattern following a bobbin change.

A bobbin change may be implemented by cutting only the bottom thread. This may be done by stopping the machine, upon a determination by the controller that a bobbin change is necessary in the midst of quilting a pattern, with the needle in the raised position typically above the presser foot, opposite the needle plate from the material, with the top thread released from the hook and the top thread take-up having withdrawn the top thread slack from below the material. With only the bottom thread extending through the hole in the needle plate to the bobbin, the bottom thread can be cut. The sewing of tack stitches before or after the bottom thread is cut may be carried out, but is not always necessary.

Figures 8A, 8B, 8C, 8D, 8E, 8F, 8G, 8H, 8I:
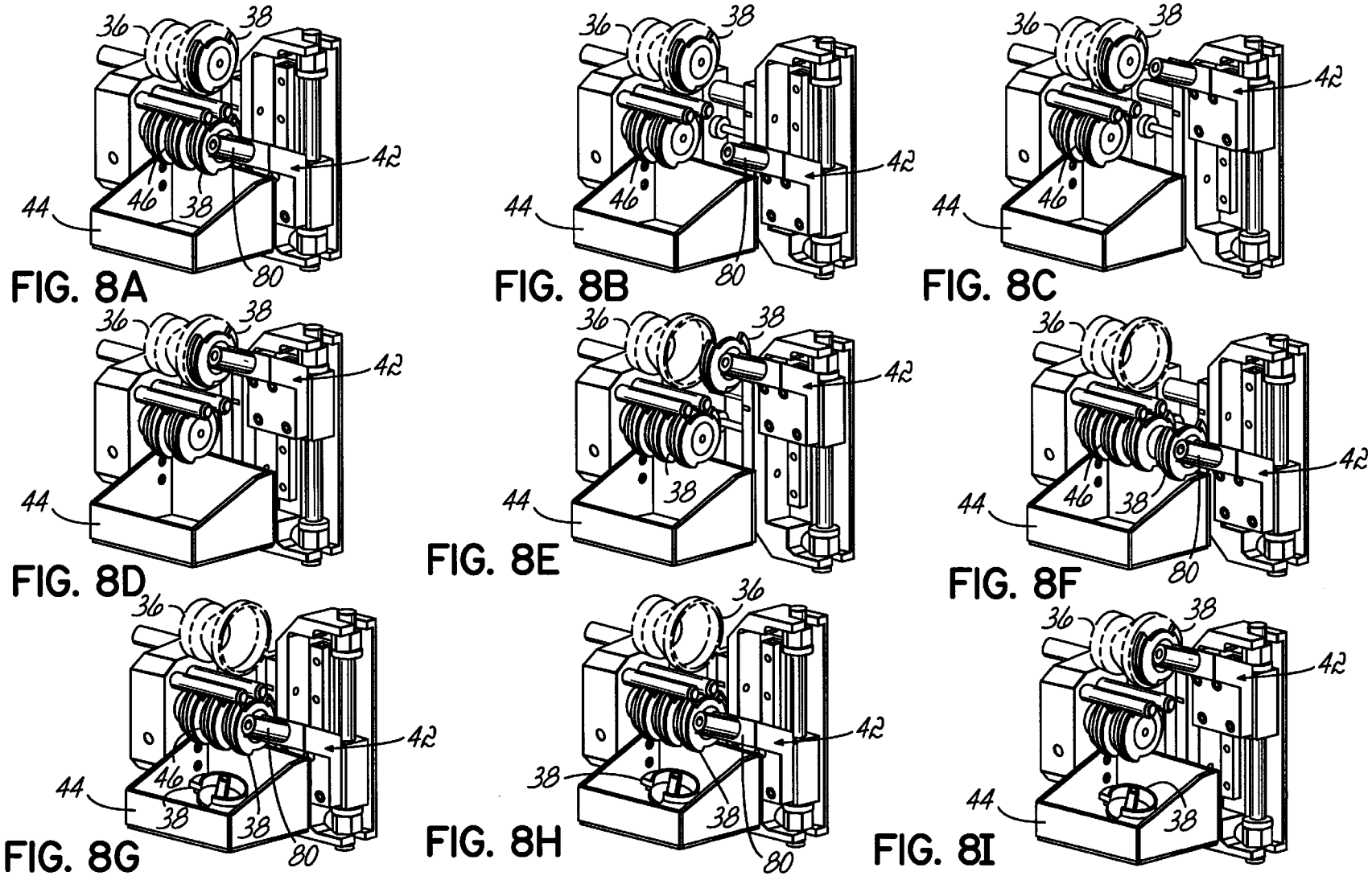
FIGS. 8A–8I illustrate each step of a cycle of operation of the bobbin changer of FIG. 1.

During a stitching cycle, the carriage 42 is generally at its lower, inner position, as illustrated in FIG. 8A, to reduce any potential for interference with the hook drive 36. In order to provide the most efficient bobbin change cycle, since the carriage must be moved from its starting, rest position adjacent the staging shaft 120 to a position adjacent the hook drive 36, the quilting machine control 140 initiates a bobbin change cycle before it detects a bobbin change stitch count. So that the carriage 42 is ready to effect a bobbin change as soon as the sewing motors and the hook drive 36 stop, the bobbin change cycle is initiated before the detection of a bobbin change stitch count by a period of time substantially equal to the time required to move the carriage 42 from its rest position to a position opposite the hook drive 36. At that time, the control 140 provides a signal on an output 142 to a horizontal solenoid valve 144, thereby switching the state of the valve 144. Pressurized fluid is appropriately ported through the valve 144 between a pressurized fluid source 146 and the horizontal cylinder 56. The horizontal cylinder 56 is activated to move the horizontal slide 62 and carriage 42 to a lower, outward position as illustrated in FIG. 8B.

Next, the control 140 provides a signal on an output 152 to a vertical solenoid valve 154 switching the state of the valve 154. Pressurized fluid is appropriately ported through the valve 154 between a pressurized fluid source 146 and the vertical cylinder 74. The vertical cylinder 74 is activated to move the carriage 42 to an upper, outward position as illustrated in FIG. 8C. The control 140 then, again, provides a signal on an output 142 to the horizontal solenoid valve 144 causing the valve 144 to operate the horizontal cylinder 56 to move the horizontal slide 62 and carriage 42 to an upper, inward position immediately adjacent the end of the hook drive 36 as illustrated in FIGS. 4 and 8D.

Substantially simultaneously with the carriage arriving at the upper, inward position of FIG. 8D, the quilting machine control 140 detects the bobbin change stitch count and provides command signals to stop the sewing head motors. Next, the quilting machine control provides a signal on an output 148 to a finger solenoid valve 150 switching the state of that valve. Fluid is ported through the valve 150 to the finger cylinder 80, thereby actuating the cylinder 80, rotating the finger 86 and pivoting the release lever 108 outward to the unlock position as previously described. That action disengages the bobbin case 38 from the hook drive 36 (FIG. 6) and clamps the bobbin case with the used spool of thread to the carriage 42. Next, the quilting machine control 140 provides a signal on the output 142 to the horizontal solenoid valve 144 changing the state of the solenoid valve 144 to reverse the operation of the horizontal cylinder 56. Thus, the horizontal slide 62, carriage 42 and bobbin case 38 are moved outward, thereby removing the bobbin case 38 from the shaft 114 of the hook drive 36. The carriage 42 and bobbin case 38 are moved outward to the position illustrated in FIG. 8E. Thereafter, the quilting machine control 140 provides an output control signal on the output 152 to a vertical solenoid valve 154 switching the state of the valve 154 and actuating the vertical cylinder 74 to lower the carriage 42 and bobbin case 38 with the used spool of thread to a position immediately over the used bobbin tray 44 as shown in FIG. 8F.

The quilting machine control 140 then supplies a control signal over the output 148 to the finger solenoid valve 150 switching the state of that valve to reverse the operation of the finger cylinder 80, thereby rotating the finger 86 back to its initial position (FIG. 4). As the finger 86 moves back to its initial position, it releases the lever 108 of the bobbin case 38; and the bobbin case 38 with the used spool of thread drops into the used bobbin tray 44 (FIG. 8G). Next, the quilting machine control 140 provides a control signal over the output 142 to operate the horizontal solenoid valve 144 such that the horizontal cylinder 56 moves the horizontal slide 62 and carriage 42 inward to a position immediately adjacent the bobbin staging shaft station 46 (FIG. 8H). The quilting machine control 140 then actuates the finger solenoid valve 150 to cause the finger solenoid 80 to again rotate the finger 86 to engage a release lever 108 of a bobbin case 38 having a full spool of thread. The pivoting motion of the finger 86 moves the release lever 108 to the unlock position which unlocks the bobbin 38 from the staging shaft 120; and simultaneously, the pivoting finger clamps the release lever 108 against the stop 106 to hold the bobbin case 38 on the carriage. Thereafter, the quilting machine control 140 operates the horizontal and vertical solenoid valves 144,154 to cause the respective horizontal and vertical cylinders 56, 74 to move the carriage 42 carrying the bobbin case 38 with the full spool of thread first, outward to remove the bobbin case 38 from the staging shaft 120 and then, up and inward to a position adjacent the end of the hook drive 36 as shown in FIG. 81.

As the horizontal slide 62 and carriage 42 carrying the bobbin case 38 with the full spool of thread move inward, the bobbin case 38 is slid over the center shaft 114 of the hook and drive 36 such that the locking tab 110 is placed in alignment with the slot 112 on the shaft 114. Thereafter, the quilting machine control 140 operates the finger solenoid valve 150 to return the finger 86 back to its rest position, thereby releasing the lever 108 from its unlock position. The lever 108 is spring biased back to its lock position, thereby locking the bobbin case 38 with the full spool of thread on the center shaft 114. The quilting machine control 140 then provides a command signal to the sewing head motors to initiate the sewing cycle; and substantially simultaneously, the quilting machine control 140 then operates the horizontal solenoid valve 144 to actuate the horizontal cylinder 56 in a manner to move the horizontal slide 62 and carriage 42 away from the hook drive 36 to its upper, outer position which was previously shown in FIG. 8C. Immediately thereafter, the control 140 provides further signals to the vertical and horizontal solenoid valves 154,144 to operate the respective vertical and horizontal cylinders 74, 56 to move the carriage 42 back to its starting rest position illustrated in FIG. 8A.

While the present invention has been illustrated by a description of one embodiment and while that embodiment has been described in considerable detail, it is not intended to restrict or in any way limit the scope of the appended claims to such detail. Additional advantages and modifications within the spirit and scope of the invention will readily appear to those skilled in the art. For example, in the described embodiment, the cylinders 56, 74 and 80 are fluid cylinders operated with pressurized air. As will be appreciated hydraulic cylinders could also be used. In addition, the commercial cylinders could be replaced by electric motor and rack and pinion drives or other known mechanisms that convert the rotary motion of the electric motor to the desired linear motion.

In the described embodiment, the stop is a resilient pad; however, as will be appreciated, a nonresilient pad may also be used if it is positioned to provide the desired clamping of the bobbin case release lever. Further, the described embodiment illustrates a single needle, however, as will be appreciated, the bobbin changer of the present invention may also be used on a quilting machine having multiple needles. Also, as will be recognized, while the bobbin changing apparatus is described herein with respect to a quilting machine, certain aspects of the bobbin changing apparatus may also have utility on nonquilting machines.

Therefore, the invention in its broadest aspects is not limited to the specific detail shown and described. Consequently, departures may be made from the details described herein without departing from the spirit and scope of the claims which follow.

What is claimed is:

1. An apparatus for automatically changing a bobbin case on a quilting machine having a hook drive operatively supporting the bobbin case during a stitching operation, the bobbin case having a release lever for unlocking the bobbin case from the hook drive, the apparatus comprising:

a staging station adapted to support at least one bobbin case;

a carriage movable between the staging station and an end of the hook drive; and a finger movably mounted on the carriage, the finger adapted to move the release lever and clamp the release lever at an unlock position;

the finger being pivotally mounted to the carriage and moves the release lever of the bobbin case with a pivoting motion and having an outer end that engages a rear surface of the release lever as the finger pivots and applies a force against the rear surface to pivot the release lever to the unlock position;

the carriage including a stop, and the finger pivoting the release lever of the bobbin case against the stop, thereby clamping the release lever against the stop and holding the bobbin case on the carriage;

the stop being a surface on a resilient pad that is fixed to the carriage.

2. The apparatus of claim 1 wherein the stop is a surface on a rubber pad.

3. An apparatus for automatically changing a bobbin case on a quilting machine having a hook drive operatively supporting the bobbin case during a stitching operation, the bobbin case having a release lever for unlocking the bobbin case from the hook drive, the apparatus comprising:

a staging station adapted to support at least one bobbin case;

a carriage movable between the staging station and an end of the hook drive;

a finger movably mounted on the carriage, the finger adapted to move the release lever and clamp the release lever at an unlock position;

the finger being pivotally mounted to the carriage and moving the release lever of the bobbin case with a pivoting motion;

the finger having an outer end that engages a rear surface of the release lever as the finger pivots and applies a force against the rear surface to pivot the release lever to the unlock position; and the finger being pivotally connected directly to a reciprocating element and pivots thereon with respect to a pivot axis located intermediate the ends of the finger.

4. An apparatus for automatically changing a bobbin case on a quilting machine having a hook drive operatively supporting the bobbin case during a stitching operation, the bobbin case having a release lever for unlocking the bobbin case from the hook drive, the apparatus comprising:

a staging station adapted to support at least one bobbin case;

a carriage movable between the staging station and an end of the hook drive;

a finger movably mounted on the carriage, the finger adapted to move the release lever and clamp the release lever at an unlock position;

a cylinder mounted on the carriage and having a reciprocating cylinder rod pivotally connected to an inner end of the finger;

the finger moving the release lever of the bobbin case with a pivoting motion, having an outer end that engages a rear surface of the release lever as the finger pivots and applies a force against the rear surface to pivot the release lever to the unlock position, and pivoting on the cylinder with respect to a pivot axis located intermediate the ends of the finger.

5. An apparatus for automatically changing a bobbin case on a quilting machine having a hook drive operatively supporting the bobbin case during a stitching operation, the bobbin case having a release lever for unlocking the bobbin case from the hook drive, the apparatus comprising:

a staging station adapted to support at least one bobbin case;

a carriage movable between the staging station and an end of the hook drive;

a finger movably mounted on the carriage, the finger adapted to move the release lever and clamp the release lever at an unlock position; and the carriage being mounted to a first slide movable along a first axis of motion, and the carriage and the first slide being mounted on a second slide movable along a second axis of motion.

6. The apparatus of claim 5 wherein the first and second axes of motion are mutually perpendicular linear axes of motion.

7. The apparatus of claim 6 further comprising a first drive mechanically supported by the second slide and mechanically supporting the carriage for moving the carriage along the first axis of motion.

8. The apparatus of claim 7 further comprising a second drive mechanically supported by the quilting machine and mechanically supporting the first drive and the carriage for moving the first drive and the carriage along the second axis of motion.

9. The apparatus of claim 8 wherein the first and second drives are fluid operated cylinders.

10. An apparatus for automatically changing a bobbin case on a quilting machine having a hook drive operatively supporting the bobbin case during a stitching operation, the bobbin case having a release lever for unlocking the bobbin case from the hook drive, the apparatus comprising:

a staging station adapted to support at least one bobbin case;

a carriage movable between the staging station and an end of the hook drive;

a finger movably mounted on the carriage, the finger adapted to move the release lever and clamp the release lever at an unlock position;

the staging shaft having an outer end with a substantially circular, cross-sectional profile; and the staging shaft being relieved to have a noncircular, cross-sectional profile beginning at a point near the outer end of the staging shaft.

11. The apparatus of claim 10 wherein the noncircular, cross-sectional profile extends over a length of the staging shaft a distance determined by a maximum number of bobbin cases to be mounted on the staging shaft.

12. The apparatus of claim 10 wherein the staging station further comprises a biasing element mounted adjacent the staging shaft for biasing the bobbin case toward the outer end of the staging shaft.

13. The apparatus of claim 12 wherein the biasing element is a compression spring.

14. The apparatus of claim 13 wherein the compression spring is mounted around the staging shaft.

15. The apparatus of claim 10 wherein the staging station further comprises alignment rods adapted to engage the bobbin case and maintain the bobbin case at a desired angular orientation with respect to the staging shaft.

16. The apparatus of claim 12 wherein the alignment rods are mounted to the staging station in parallel with the staging shaft.

17. A lock stitch quilting method comprising:

first quilting at least a portion of a pattern on at least one quilted product;

automatically acquiring during the first quilting step information relating to an amount of bobbin thread used;

processing data to automatically determine the need for a bobbin change based at least in part on the acquired information;

in response to the determination, during a pause in the quilting of products and before all thread on a bobbin is used, automatically replacing a bobbin of which the information of said amount of thread was acquired with another bobbin having thread thereon;

the information acquiring step including counting stitches sewn on quilted products with thread from the bobbin being replaced and the processing step including correlating the counted stitches with stored information and calculating therefrom the amount of thread remaining on the bobbin being replaced.

18. A lock stitch quilting method comprising:

first quilting at least a portion of a pattern on at least one quilted product;

automatically acquiring during the first quilting step information relating to an amount of bobbin thread used;

processing data to automatically determine the need for a bobbin change based at least in part on the acquired information;

in response to the determination, during a pause in the quilting of products and before all thread on a bobbin is used, automatically replacing a bobbin of which the information of said amount of thread was acquired with another bobbin having thread thereon;

the bobbin replacing being carried out between the quilting of different products.

19. A lock stitch quilting method comprising:

first quilting at least a portion of a pattern on at least one quilted product;

automatically acquiring during the first quilting step information relating to an amount of bobbin thread used;

processing data to automatically determine the need for a bobbin change based at least in part on the acquired information;

in response to the determination, during a pause in the quilting of products and before all thread on a bobbin is used, automatically replacing a bobbin of which the information of said amount of thread was acquired with another bobbin having thread thereon;

the bobbin replacing including, before replacing the bobbin, the steps of:

stopping the quilting of a pattern, and cutting at least a bottom thread in an extent thereof between material being quilted and the bobbin being changed.

20. The quilting method of claim 19 wherein a bottom thread is cut without cutting a top thread extending between the material and a needle.

21. The quilting method of claim 19 wherein the bobbin replacing further includes, before replacing the bobbin, the step of:

cutting a top thread extending between the material and a needle.

22. The quilting method of claim 19 wherein the bobbin replacing includes, before replacing the bobbin and before cutting a bottom thread and after stopping the quilting of a pattern, the step of:

sewing tacking stitches on material being quilted.

23. A lock stitch quilting method for automatically changing a bobbin case on a quilting machine having a hook drive operatively supporting the bobbin case during a stitching operation, the bobbin case having a release lever for unlocking the bobbin case from the hook drive, the method comprising:

first quilting at least a portion of a pattern on at least one quilted product;

automatically acquiring during the first quilting step information relating to an amount of bobbin thread used;

processing data to automatically determine the need for a bobbin change based at least in part on the acquired information;

in response to the determination, during a pause in the quilting of products and before all thread on a bobbin is used, automatically replacing a bobbin of which the information of said amount of thread was acquired with another bobbin having thread thereon;

moving a carriage to a position adjacent a first bobbin case mounted on the hook drive such that a finger movably mounted on the carriage is located adjacent a release lever of the first bobbin case;

moving the finger behind the release lever of the first bobbin case and pivoting the release lever of the first bobbin case outward with the finger;

clamping the release lever of the first bobbin case between the finger and a stop surface on the carriage;

moving the carriage away from the hook drive, thereby removing the first bobbin case from the hook drive;

moving the finger on the carriage away from the stop surface, thereby releasing the lever and permitting the first bobbin case to drop from the carriage;

moving the carriage to a position adjacent a second bobbin case such that the finger on the carriage is located adjacent a release lever of the second bobbin case;

moving the finger behind the release lever of the second bobbin case and pivoting the release lever of the second bobbin case outward with the finger;

clamping the release lever of the second bobbin case between the finger and the stop surface on the carriage;

moving the carriage to the location adjacent the hook drive; and moving the finger on the carriage away from the stop surface, thereby releasing the lever and mounting the bobbin case onto the hook drive.

24. A lock stitch quilting apparatus comprising:

an automatic bobbin changer;

means for automatically acquiring, during quilting, information relating to an amount of bobbin thread used;

a controller programmed to process data to automatically determine the need for a bobbin change based at least in part on the acquired information, in response to the determination, during a pause in the quilting of products and before all thread on a bobbin is used, signaling the automatic bobbin changer to automatically replace a bobbin of which the information of said amount of thread was acquired with another bobbin having thread thereon;

the information acquiring means includes a stitch counter operable to count stitches sewn on quilted products with thread from the bobbin being replaced; and the controller is programmed to correlate the counted stitches with stored information and calculating therefrom the amount of thread remaining on the bobbin being replaced.

25. A lock stitch quilting apparatus comprising:

an automatic bobbin changer;

means for automatically acquiring, during quilting, information relating to an amount of bobbin thread used;

a controller programmed to process data to automatically determine the need for a bobbin change based at least in part on the acquired information, in response to the determination, during a pause in the quilting of products and before all thread on a bobbin is used, signaling the automatic bobbin changer to automatically replace a bobbin of which the information of said amount of thread was acquired with another bobbin having thread thereon;

the controller being operable to cause the bobbin to be replaced between the quilting of different products.

26. A lock stitch quilting apparatus comprising:

an automatic bobbin changer;

means for automatically acquiring, during quilting, information relating to an amount of bobbin thread used;

a controller programmed to process data to automatically determine the need for a bobbin change based at least in part on the acquired information, in response to the determination, during a pause in the quilting of products and before all thread on a bobbin is used, signaling the automatic bobbin changer to automatically replace a bobbin of which the information of said amount of thread was acquired with another bobbin having thread thereon;

the controller being operable to initiate, before the bobbin is replaced, the stopping of the quilting of a pattern and the cutting of at least a bottom thread in an extent thereof between material being quilted and the bobbin being changed.

27. The quilting apparatus of claim 26 wherein the controller is operable to initiate the cutting of a bottom thread without cutting a top thread extending between the material and a needle.

28. The quilting apparatus of claim 26 wherein the controller is operable to initiate, before the bobbin is replaced, a cutting of a top thread extending between the material and a needle.

29. The quilting apparatus of claim 26 wherein the controller is operable to initiate, before the bobbin is replaced and before the cutting of a bottom thread, the sewing tacking stitches on material being quilted.

* * * * *